United States Patent [19]

Morgan

[11] 4,341,400

[45] Jul. 27, 1982

[54] SKI REST FOR A SKI POLE

[76] Inventor: Leonard M. Morgan, Rte. 1, Box A136, Kansasville, Wis. 53139

[21] Appl. No.: 97,881

[22] Filed: Nov. 26, 1979

[51] Int. Cl.[3] ..... A63C 11/22

[52] U.S. Cl. ..... 280/819

[58] Field of Search ..... 280/812, 813, 816, 819, 280/820, 809; 254/DIG. 14; 294/15, DIG. 2, 86 CG, 92; 104/173 ST

[56] References Cited

U.S. PATENT DOCUMENTS

| | | | |
|---|---|---|---|
| 801,398 | 10/1905 | Ray | 297/429 |
| 2,244,650 | 6/1941 | Curran et al. | 155/2 |
| 2,834,604 | 5/1958 | Osmun | 280/11.37 |
| 3,001,483 | 9/1961 | Gmeiner | 104/173 ST |
| 3,110,268 | 11/1963 | Allsop | 104/173 ST |
| 3,179,436 | 4/1965 | Choy | 280/11.37 |
| 3,205,006 | 9/1965 | Mommsen | 297/423 |
| 3,350,111 | 10/1967 | Sahlein et al. | 280/11.37 |
| 3,893,606 | 7/1975 | Hofmann | 280/814 |
| 3,929,345 | 12/1975 | Nasby et al. | 280/813 |
| 4,120,532 | 10/1978 | Clanan | 297/429 |
| 4,299,409 | 11/1981 | Gedicks | 280/824 |

FOREIGN PATENT DOCUMENTS

| | | | |
|---|---|---|---|
| 503168 | 7/1930 | Fed. Rep. of Germany | 135/66 |
| 2104014 | 8/1972 | Fed. Rep. of Germany | 280/813 |

*Primary Examiner*—David M. Mitchell

*Attorney, Agent, or Firm*—Wegner, McCord, Wood & Dalton

[57] ABSTRACT

A ski rest permanently mountable on a ski pole for use by a skier while travelling on a ski chair lift by engagement with a lift chair whereby a skier may place his attached skis on the basket of the ski pole for support thereof during travel and the supported weight is transferred to the lift chair and having an arm movably mounted on the ski pole intermediate the ends thereof for movement between a retracted position, substantially parallel to the ski pole to avoid interference with the skier during skiing, and an operative position extending generally normal to the ski pole.

6 Claims, 7 Drawing Figures

20
2.
2.
S
10
11
21
14
12
15

47
45
31
40
S
25
42
3.
30
46
20
41
43
3.

45
31
S
25
47
26
30
20
42

47
20
S
5.
5.
42

42
20
25
43
41

70
S'
52
55
53
26'
51
50
20

S'
45'
50
70
52
51
46'
50

SKI REST FOR A SKI POLE

BACKGROUND OF THE INVENTION

This invention pertains to a ski rest which may be permanently associated with the ski pole and the combination thereof with the ski rest having an operative position extending outwardly from the ski pole for engagement with the chair of a chair lift to permit a skier to rest his attached skis on the basket of the ski pole whereby the weight of the skier's legs, boots, and skis is transferred to the chair to enable resting of the legs while the skier is travelling on the lift.

SUMMARY OF THE INVENTION

A primary feature of the invention disclosed herein is to provide a ski rest attachable to a ski pole in a manner whereby it will not interfere with normal use of the ski poles during skiing, but can become operative at the time the skier is travelling on a ski chair lift to support the ski pole from the lift chain whereby the skier may place his attached skis on the basket of the ski pole and the weight of the skier's legs, boots and skis is supported from the lift chain to permit resting of the skier's legs.

More particularly, the ski rest is in the form of an arm movably mounted on the ski pole intermediate the ends thereof and has a retracted position extending generally parallel to the ski pole for noninterference during skiing and an extended operative position substantially normal to the ski pole to rest upon the upper surface of the lift chair for firm support of the ski pole in a position whereby the skier can place his skis on the basket of the ski pole and the weight of the skier's legs and attached skiing equipment is transferred to the lift chair and acts to hold the ski rest associated with the lift chair.

In a preferred embodiment, the ski rest is in the form of an arm having a body with an angled section at an end thereof and having an opening in said angled section for loosely receiving the ski pole and shaped to permit movement of the arm between a retracted position closely adjacent and parallel to the ski pole and an extended position at a slight downward angle from normal to said ski pole. The opening has a pair of edges located to engage opposite sides of the ski pole at two locations along the length thereof when the arm is in extended operative position to prevent movement of the arm beyond said extended position when the arm is resting on the lift chair and a skier has the weight of his legs and attached skiing equipment supported on the ski basket of the ski pole.

The ski rest of said preferred embodiment is formed of a material and shaped to have adequate strength for supporting the weight of a skier's legs and attached equipment when in use and to partially surround and releasably snap onto the ski pole when in said closely adjacent parallel retracted position.

In other embodiments of the invention, the ski rest can either be pivotally attached to the ski pole by pins means extended through the ski pole or through an adjustable bracket which can be attached to the ski pole and the arm of the ski rest is spring-urged to the retracted position.

DESCRIPTION OF THE PREFERRED EMBODIMENT

Figure 1:
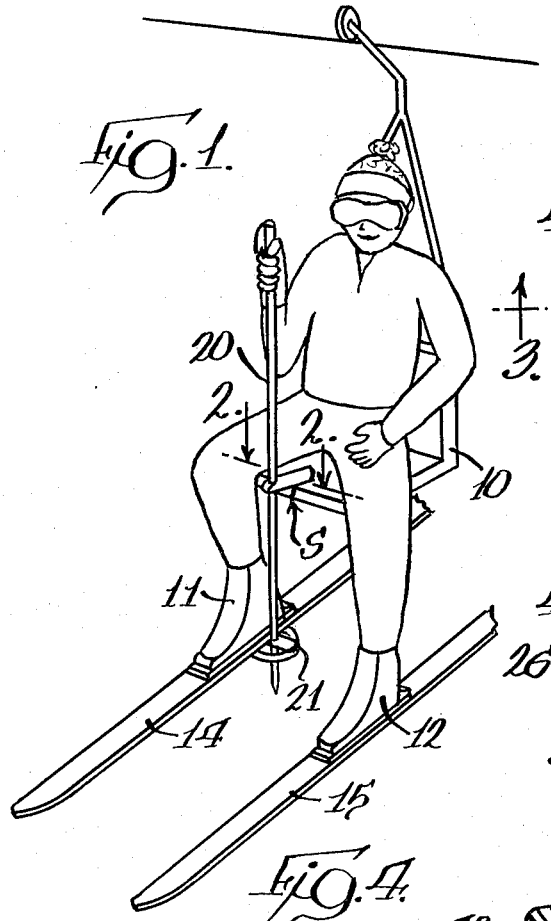
FIG. 1 is a view showing the ski rest in use.
Figure 2:
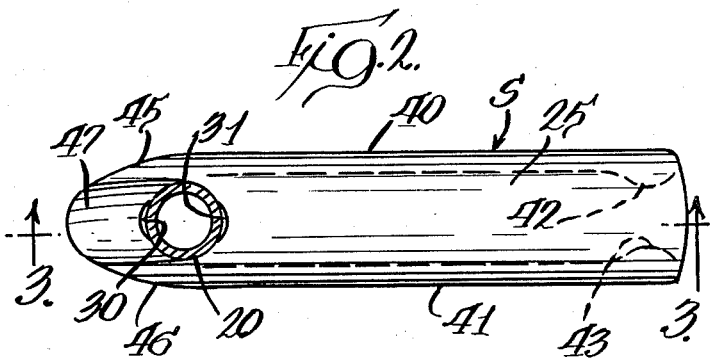
FIG. 2 is a plan view, taken generally along the line 2—2 in FIG. 1 and with the ski pole in section.
Figure 3:
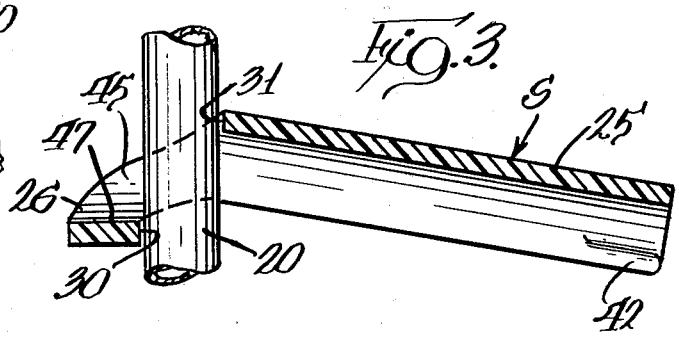
FIG. 3 is a vertical section, taken generally along the line 3—3 in FIG. 2.

The ski rest S is shown in use in FIG. 1 wherein a skier is seated on a lift chair 10 of a ski chair lift and is equipped with ski boots 11 and 12 to which skis 14 and 15 are attached. A ski pole 20 has an oversize ski basket 21 at the lower end thereof and has the ski rest S in operative position engaging the upper surface of the lift chair 10.

A preferred embodiment of the ski rest S is shown particularly in FIGS. 2 to 5 and is in the form of an arm having a body 25 with an angled section 26 at an end thereof. The angled section has an opening which loosely receives the ski pole 20 and permits movement of the ski rest between the retracted position, shown in FIG. 4, and an extended operative position shown in FIGS. 2 and 3.

Figure 4:
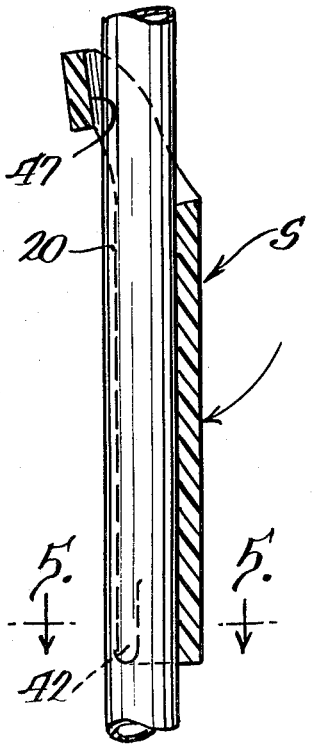
FIG. 4 is a longitudinal central section through the ski rest shown in retracted position in association with the ski pole.

In the retracted position of FIG. 4, the ski rest lies closely adjacent and in parallel relation to the ski pole 20 whereby the ski rest does not interfere with normal use of the ski poles while skiing. In extended position, the ski rest extends generally normal to the length of the ski pole and preferably at a slight downward angle from normal of approximately 10°. With the opening in the angled section 26, it will be seen that the arm is free to rotate between the positions of FIGS. 2 and 4. In the operative position of FIGS. 2 and 3, there are opening edges 30 and 31 which engage the ski pole at spaced positions along the length thereof and prevent movement of the arm in a counterclockwise direction beyond the extended position shown whereby during use the ski rest is effective to transfer weight applied to the ski pole to the lift chair.

Figure 5:
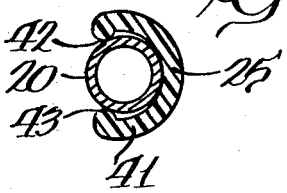
FIG. 5 is a section, taken generally along the line 5—5 in FIG. 4.

The arm body 25 is of a generally semi-cylindrical cross-section to form a shape which partially surrounds the ski pole, as shown in FIG. 5. The arm is made of a material, such as metal or plastic, and shaped to have the necessary strength for the aforementioned weight transfer during use and also to have a pair of walls 40 and 41 with sufficient flexibility whereby projections 42 and 43 on the respective walls may snap onto the ski pole and retain the ski rest in the retracted position shown in FIGS. 4 and 5. The body walls 40 and 41 continue into the angled section 26 with wall sections 45 and 46, respectively, which span opposite sides of the ski pole 20 and which are connected by a connecting section 47 having a generally concave curvature to partially wrap around the ski pole in the retracted position.

With the construction described, the ski pole 20 having the ski rest S may be used during skiing with the ski rest in the retracted position, shown in FIG. 4. For travel on the ski chair lift, the skier releases the ski rest from the retracted position and pivots it to the operative position, shown in FIGS. 2 and 3. The ski rest is placed upon the lift chair 10, as shown in FIG. 1. The skier then places both skis on the basket 21 of the ski pole, whereby the weight of the skier's legs and attached ski equipment, namely the boots 11 and 12 and skis 14 and 15, is transferred to the lift chair to permit full relaxation of the skier's legs. The ski rest may be located along the length of the ski pole at any desired position to accommodate the length of the skier's legs.

The slight downward angle of the ski rest relative to the ski pole assists in holding the ski rest in position on the lift chair.

The ski rest is initially mounted on a conventional ski pole after removal of the ski basket 21 which is furnished with the ski pole and, after placement on the ski pole, an over-size ski basket 21 is associated with the pole whereby it is of a sufficient diameter to firmly support the pair of skis 14 and 15 at opposite sides of the ski pole 20.

Figure 6:
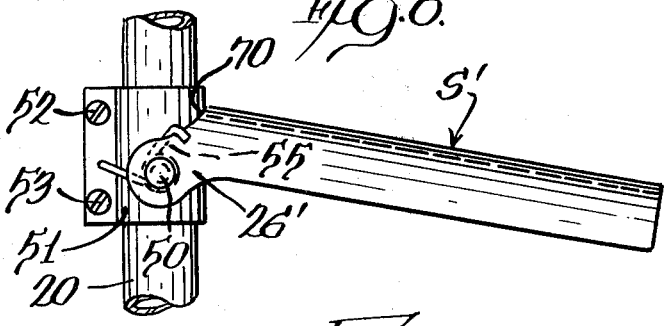
FIG. 6 is a side elevational view of an alternate embodiment of the ski rest shown in association with a ski pole.
Figure 7:
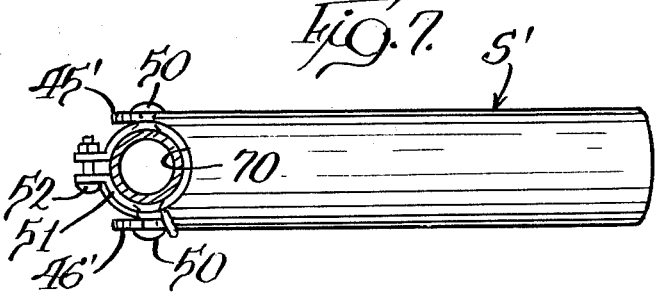
FIG. 7 is a plan view of the ski rest shown in FIG. 6 with the ski pole in section.

An alternate embodiment is shown in FIGS. 6 and 7, with a variation in the attachment of the ski rest S' to the ski pole 20. In this embodiment, the ski rest is pivotally attached to the ski pole at a desired location by an attaching annular clamp 51 which surrounds the ski pole and is securely attached thereto by a pair of attaching bolts 52 and 53. Pin means in the form of headed rivets 50 extend through the wall of the annular clamp 51 and walls 45' and 46' of the angled section 26' to provide a pivot mounting for the ski rest. The ski rest S' is urged to and maintained in a retracted position by spring means in the form of a spring 55 mounted on one of the headed rivets 50 and which coacts between the clamp 51 and the ski rest and urges the ski rest in a clockwise direction, as viewed in the drawing.

The body 25' of semi-cylindrical cross-section permits the close positioning to the ski pole when in retracted position. The extended position is controlled by engagement between an edge 70 on the body and the ski pole.

The ski rest structures disclosed herein provide lightweight, simply manufactured structures which can be associated with a ski pole in permanent relation without interfering with a skier during skiing and which can simply be moved to an extended operative position to provide support for a skier's legs, ski boots and skis with transfer of the weight thereof to the lift chair. The weight maintains the ski rest in association with the lift chair without requiring the skier to manually hold the ski in a weight-transferring relation with the lift chair. Actual experience with the ski rest has shown that the rest given to the skier's legs permits additional hours of skiing.

I claim:

1. A ski pole having a ski rest for use by a skier while travelling on a ski chair lift comprising, an arm movably mounted on the ski pole intermediate the ends thereof for movement between a retracted position substantially parallel to the pole and an extended position extending generally normal to the pole for engagement with a lift chair whereby a skier may place his attached skis on the basket of the ski pole for support thereof during travel and the supported weight is transferred to the lift chair, said arm having an opening adjacent an end thereof for loosely receiving said ski pole and of a size to permit movement of the arm between said two positions, and two edges of said opening engaging opposite sides of the ski pole when the arm is in said extended position to prevent movement of said arm beyond said extended position.

2. A ski pole having a ski rest as defined in claim 1 wherein said arm has a body with a substantially semi-cylindrical cross-section of a size to partially surround said ski pole when in said retracted position and having means for releasably locking thereof to the ski pole.

3. A ski pole having a ski rest as defined in claim 2 wherein said arm is formed of a plastic material and the body shape thereof provides a pair of opposed flexible walls with said locking means comprising a pair of projections positioned one on each wall to releasably snap onto said ski pole.

4. A ski rest for use with a ski pole comprising, an arm having a body and an angled section at one end thereof, an opening in said angled section for loosely receiving said ski pole and shaped to permit movement of the arm between a restricted position closely adjacent and parallel to said ski pole and an extended position generally normal to said ski pole, said opening having a pair of edges located to engage opposite sides of the ski pole at two locations along the length thereof when the arm is in extended position to prevent movement of the arm beyond said extended position.

5. A ski rest as defined in claim 4 wherein said body has a semi-cylindrical cross-section to partially wrap around said ski pole when in retracted position and has means for releasably engaging said ski pole to hold the arm in retracted position.

6. A ski rest as defined in claim 5 wherein said arm is of a material and said body of a structural shape whereby the arm can support the weight of a skier's legs, boots and skis in extended position and snap onto the ski pole when in retracted position.

* * * * *